US007966677B2

(12) United States Patent
Miller et al.

(10) Patent No.: US 7,966,677 B2
(45) Date of Patent: Jun. 28, 2011

(54) ADJUSTABLE MOUNT FOR SHOWERHEAD

(75) Inventors: Michael Miller, Portage, MI (US); Curtis J. Bailey, Birmingham, MI (US); Noah Dingler, Waterford, MI (US); Dominic Daunter, Howell, MI (US)

(73) Assignee: Alsons Corporation, Hillsdale, MI (US)

( * ) Notice: Subject to any disclaimer, the term of this patent is extended or adjusted under 35 U.S.C. 154(b) by 1350 days.

(21) Appl. No.: 11/506,160

(22) Filed: Aug. 17, 2006

(65) Prior Publication Data

US 2007/0067902 A1 Mar. 29, 2007

Related U.S. Application Data

(60) Provisional application No. 60/709,070, filed on Aug. 17, 2005.

(51) Int. Cl.
*A47K 3/20* (2006.01)

(52) U.S. Cl. ..... 4/570

(58) Field of Classification Search ..... 4/568, 615–618, 4/675–678, 570–567; 239/282, 283
See application file for complete search history.

(56) References Cited

U.S. PATENT DOCUMENTS

| | | | | |
|---|---|---|---|---|
| 2,873,999 | A | | 2/1959 | Webb |
| 2,966,311 | A | | 12/1960 | Davis |
| 3,404,410 | A | | 10/1968 | Sumida |
| 3,826,454 | A | | 7/1974 | Zieger |
| 3,865,310 | A | | 2/1975 | Elkins |
| 3,979,096 | A | | 9/1976 | Zieger |
| 4,091,998 | A | | 5/1978 | Peterson |
| 4,174,822 | A | | 11/1979 | Larsson |
| D255,626 | S | | 7/1980 | Grube |
| D267,582 | S | | 1/1983 | Mackay |
| 4,674,687 | A | * | 6/1987 | Smith et al. ..... 239/447 |
| 4,719,654 | A | | 1/1988 | Blessing |
| D296,582 | S | | 7/1988 | Haug |
| 4,964,573 | A | | 10/1990 | Lipski |
| 5,070,552 | A | | 12/1991 | Gentry |
| 5,230,106 | A | * | 7/1993 | Henkin et al. ..... 4/541.4 |
| D412,563 | S | | 8/1999 | Milrud |
| 6,450,425 | B1 | | 9/2002 | Chen |
| 6,453,486 | B1 | | 9/2002 | Chen |
| 6,502,796 | B1 | | 1/2003 | Wales |
| 6,611,971 | B1 | | 9/2003 | Antoniello |
| 6,671,896 | B2 | | 1/2004 | Tse |
| 6,757,920 | B2 | | 7/2004 | Antoniello |

* cited by examiner

*Primary Examiner* — Huyen Le
(74) *Attorney, Agent, or Firm* — Carlson, Gaskey & Olds PC

(57) ABSTRACT

A shower mount is mounted to a fixed shower arm in a bathing area for universally receiving a hand-held showerhead. The shower mount is connected to the shower arm and includes a base member with a fluid passageway in communication with the shower arm and a shower hose. Water flows through the fluid passageway and shower hose to a showerhead. A shower saddle is interchangeably mounted the base member to support the showerhead. The shower saddle is selected depending upon the design of the showerhead in order to securely retain the showerhead to the base member.

9 Claims, 4 Drawing Sheets

ADJUSTABLE MOUNT FOR SHOWERHEAD

The present invention claims the benefit of U.S. Provisional Patent Application No. 60/709,070, filed on Aug. 17, 2005.

BACKGROUND OF THE INVENTION

This invention relates to a mounting saddle for a hand-held shower. In particular, a mount adaptable to retain various hand-held shower at the shower arm for dispensing shower water.

Hand-held showers have become widely accepted as a necessary convenience for bathing. In order to eliminate the need for both a hand-held shower and an overhead or fixed showerhead, means have been developed for securing the hand-held shower at or near the shower arm extending from the wall. In such a position, the hand-held shower operates as an overhead shower for general bathing yet can be removed for specific bathing requirements. Water is directed to the hand-held through a hose which is in fluid communication with the shower arm on the wall.

Because hand-held showers are offered in a variety of shapes, sizes and finishes, a different mount may be required for each product. The mount must be configured to snugly receive the hand-held shower to prevent inadvertent release. Depending upon the offering of hand-held shower, a corresponding number of mounts may be required resulting in increased manufacturing and inventory requirements.

Accordingly, providing an improved arrangement for a showerhead mount adaptable to receive multiple handle designs is desired.

SUMMARY OF THE INVENTION

An example shower according to this invention provides an interchangeable shower mount to accommodate varying shower handle configurations and finishes.

The shower mount includes a base member and a shower saddle. The base member is adapted to be threadably attached to a fixed shower arm extending from the wall in the bathing area. The base member has a through bore to direct fluid flow from the shower arm to a shower hose connected to a downstream end of the base member. Water flows through the shower hose to a shower head connected at the opposing end.

The shower saddle is mounted to the base member to support the shower head. The shower saddle is interchangeable to accommodate a specific design of the shower head. A retaining feature on the base member locks with a snap feature on the shower saddle to retain the shower saddle to the base member. A release on the base member can disconnect the shower saddle. As a result, the base member can be utilized with a variety of shower saddles thereby reducing manufacturing and inventory costs. To further customize the shower mount, different connectors can be used with the base member for attaching the shower mount to the shower arm to accommodate differing shower arm designs.

These and other features of the present invention can be best understood from the following specification and drawings, the following of which is a brief description.

DETAILED DESCRIPTION OF THE PREFERRED EMBODIMENT

Figure 1:
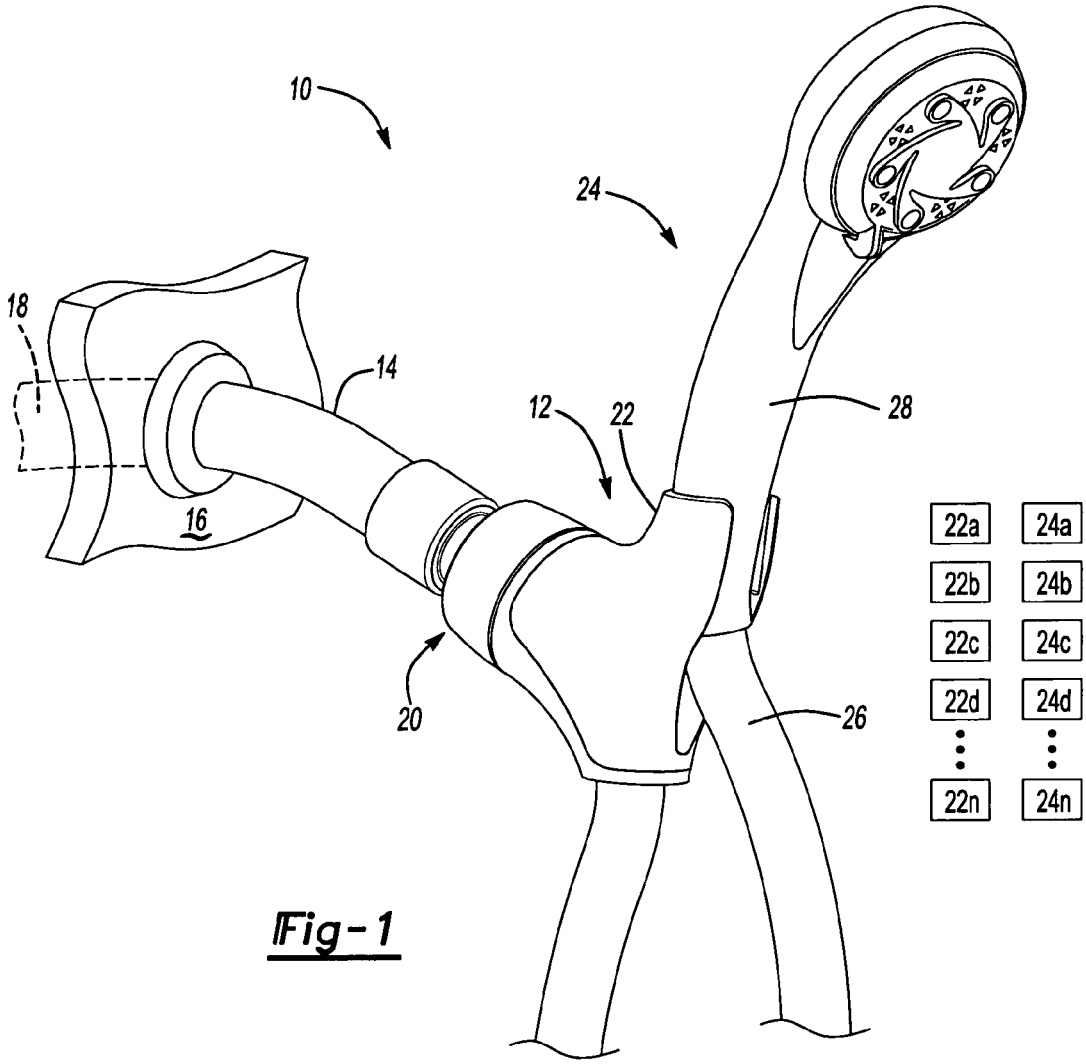
FIG. 1 is a perspective view of an example shower of the present invention.

FIG. 1 is a perspective view of an example shower 10 having a shower mount 12. A shower arm 14 extends from a wall 16. The shower arm 14 is fluidly connected to a water supply 18 to provide hot and cold water for the shower 10. The shower mount 12 includes a base member 20 and a shower saddle 22. The base member 20 is used to connect a showerhead 24 to the shower arm 12. A shower hose 26 extends between the showerhead 24 and the base member 20. The showerhead 24 is supported on the shower mount 12 and can be removed to allow handling by a user. The showerhead 24 includes a handle 28 to support the showerhead 24 on the shower saddle 22. The handle 28 can be removed from shower saddle 22 when desired by the user. The handle 28 includes a nut used to attach the shower hose 26 to the handle 28. The nut fits within the shower shower saddle 22. The shapes of the handle 28, including the nut determine the shape of the shower saddle 22.

As shown, there are plural saddle 22*a-n* and plural showerhead 34*a-n*. Each of the saddles 22*a-n* will fit on the common base member 20. Thus, a selected saddle and showerhead can be mated to the base member 20.

Figure 2:
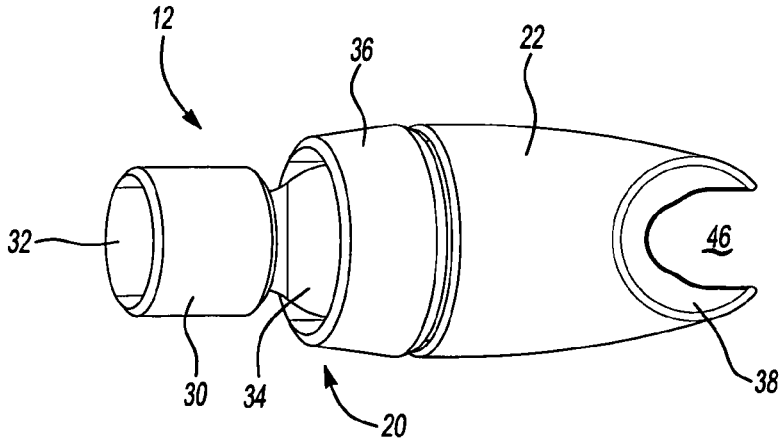
FIG. 2 is a top view of the example shower mount.

FIG. 2 is a top view of the example shower mount 12. The base member 20 includes an attaching portion 30 extending therefrom. The attaching portion 30 has a threaded connection 32 to mate with the shower arm 14 in a typical manner. By replacing the attaching portion 30 the base member 20 can be adapted to fit differing shower arms 12. A ball joint 34 is located between the attaching portion 30 and a sleeve 36 the base member 20. The ball joint 34 rotates relative to the sleeve 36. Thus, the shower mount 12 can be rotatably adjusted relative to the shower arm 14.

The shower saddle 22 is mounted to the base member 20 and extends in an opposing direction from the attaching portion 30. The shower saddle 22 includes a handle support 38 that extends in an opposing direction from the attaching portion 28. The handle support 38 is shaped to receive the handle 28, including the nut.

Figure 3:
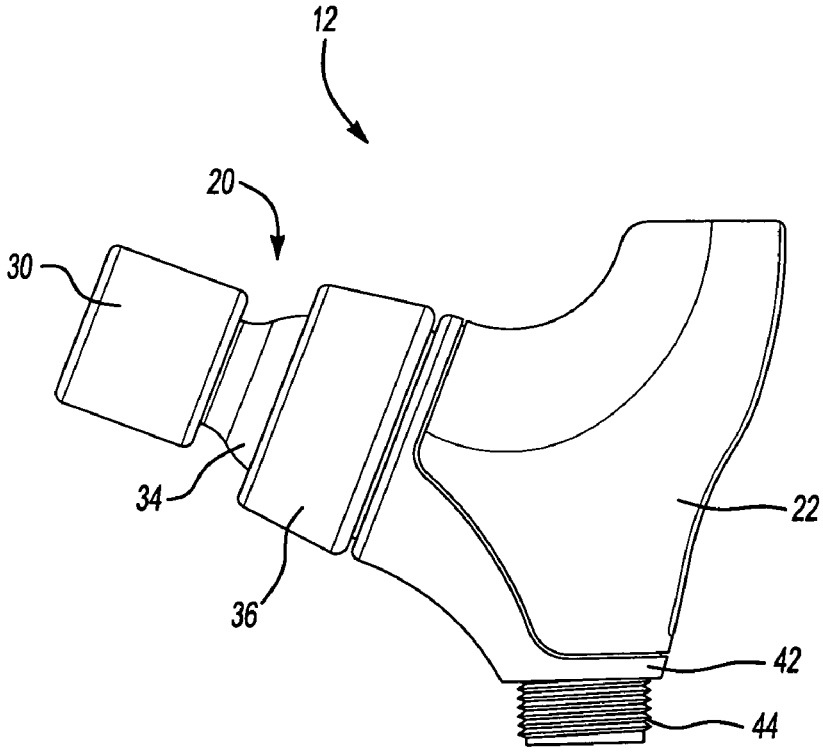
FIG. 3 is a side view of the example shower mount.

FIG. 3 is a side view of the example shower mount 12. The base member 20 includes a support portion 42 that extends out to support the shower saddle 22. A connector 44 extends downward from the support portion 42 for attaching the shower hose 26 (shown in FIG. 1). The connector 44 is preferably a threaded connection as is typical for shower hoses 26.

Figure 4:
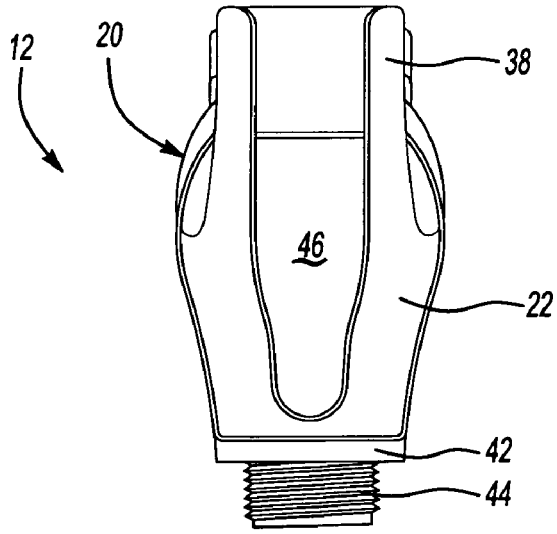
FIG. 4 is a front view of the example shower mount.

FIG. 4 is a front view of the example shower mount 12. The handle support 38 includes a handle slot 46 shaped to receive the handle 28.

Figure 5:
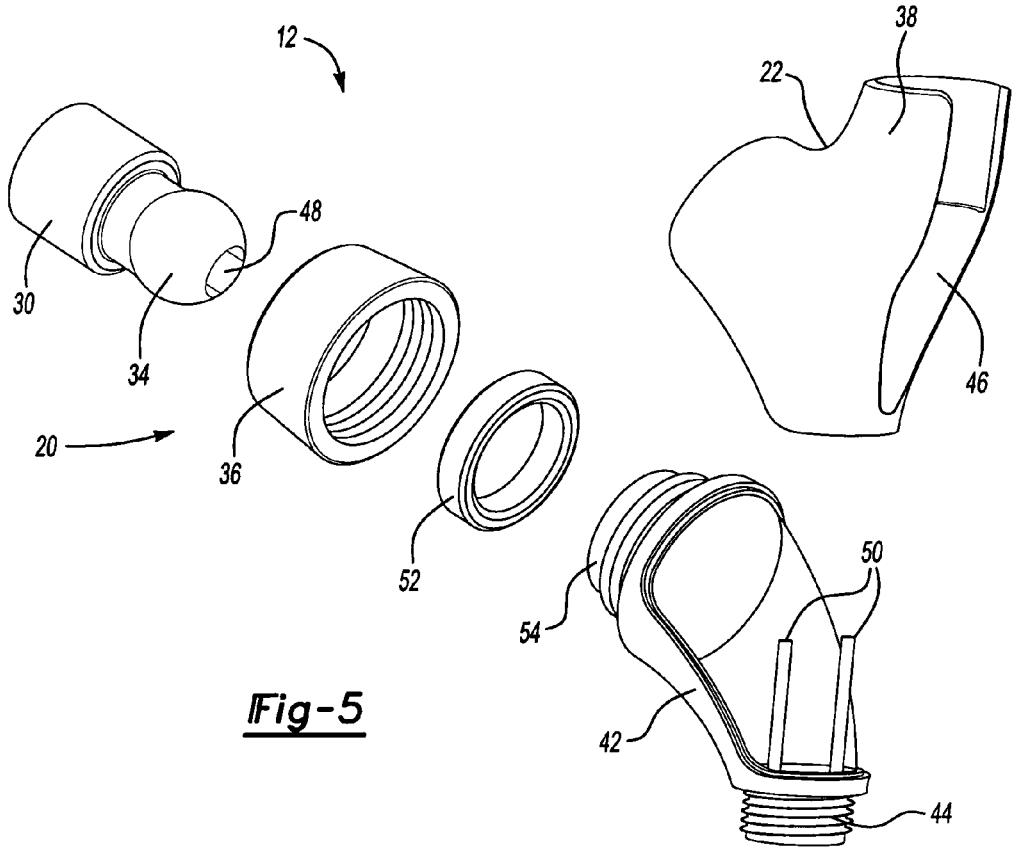
FIG. 5 is an exploded view of the example shower mount.

FIG. 5 is an exploded view of the example shower mount 12 including the base member 20 and the shower saddle 22. The shower saddle 22 is preferably manufactured as a separate component from the base member 20. The base member 20 is manufactured from a high grade plastic or other material suitable to act as a water conduit 48 for water from the water supply 18 to the shower hose 26. The shower saddle 22 is made from a material adaptable to have different surface finishes, such as chrome plating, or color applied. One skilled in the art would know suitable materials and application methods for the desired surface finishes.

Guiding features 50 on the base member 20 are used to align the shower saddle 22. A gasket 52 is located within the base member 20 once assembled to prevent water leaks from the water conduit 48. The base member 20 includes the supporting portion 42 to received the shower saddle 22. The gasket 52 fits between the support portion 42 and the sleeve 36. The support portion 42 has a threaded member 54 to fit with and retain the support portion 42 to the sleeve 36.

Figure 6:
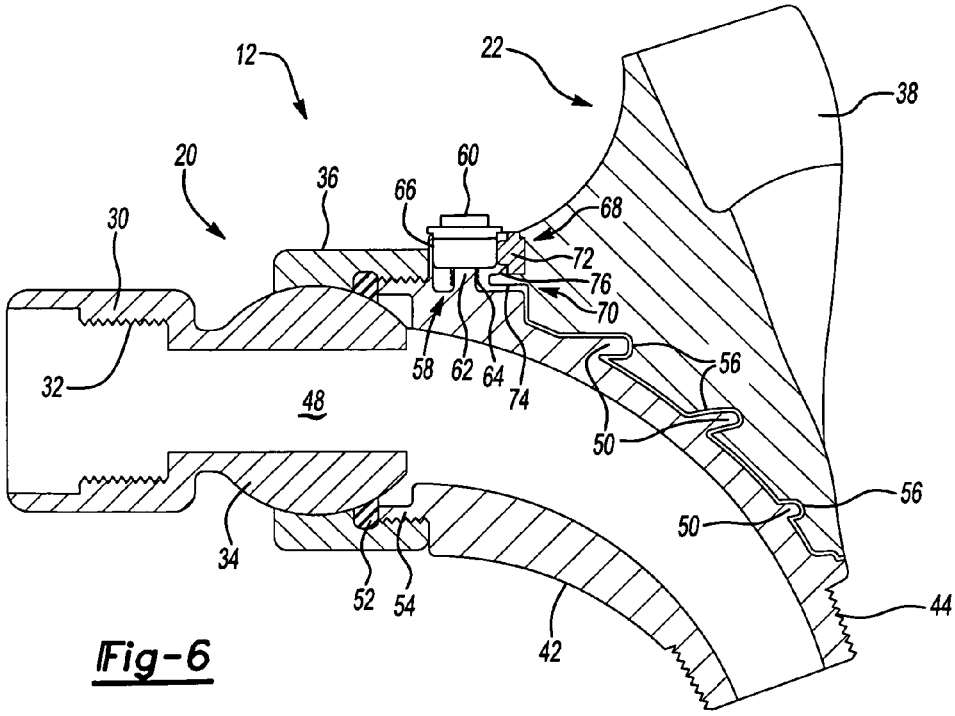
FIG. 6 is a cross-section of the example shower mount.

FIG. 6 is a cross-section of an assembled shower mount 12. The threaded connection 32 is adapted to fit the typical shower arm 12 (shown in FIG. 1). The threaded connection 32, the ball joint 34 and the supporting portion 42 define the water conduit 48. The gasket 52 is located between the support portion 42 and the sleeve 36 to seal the water conduit 48. Pressure is applied to the gasket 52 when the threaded member 54 is received within the sleeve 36.

Guiding feature 50 correspond with the guided features 56. A retaining feature 52 removable secures the shower saddle 26 to the base member 18. A release button 60 is mounted on a support post 62 and biased away from the base member 20 with a spring 64. The release button 60 extends through a slot 66 in the base member 20 to be accessed by the user.

A first interlocking feature 68 within the base member 20 interlocks with a second interlocking feature 70 on the shower saddle 22. In the example shown, the first interlocking feature 68 is a protrusion 72 extending inwardly from the base member 20. The second interlocking feature 70 is a snap feature 74 extending from the shower saddle 26. The snap feature 74 is a u-shaped design having a locking portion 76. The u-shape of the snap feature 74 biases the locking portion 76 away from the shower saddle 26 and toward the protrusion 72.

The guided features 56 on the shower saddle 22 are aligned with guiding features 50 on the base member 20. Pressure is applied to move the shower saddle 22 against the base member 20. The snap feature 74 is pushed together as it passes by the protrusion 72. Once the snap feature 74 moves past the protrusion 72 it returns to the original position. The locking portion 76 interfits with the protrusion 72 to prevent the shower saddle 22 from moving away from the base member 20.

To release the shower saddle 22, pressure is applied to the release button 60 by the user. The release button 60 is moved toward the base member 20 overcoming the bias of spring 64. The movement of the release button 60 acts on the snap feature 74 to squeeze the snap feature 68 together allowing the locking portion 76 to move past the protrusion 72. Once the snap feature 74 moves past the protrusion 72 it returns to the original position.

The finish of the shower saddle 22 and the shape of the handle support 38 can be selected to correspond to a desired handle 28 configuration and finish. Multiple shower saddles 22 with different handle supports 38 and finishes can be manufactured to secure with the base member 20. The shower saddle 22 can be selected and replaced base upon the configuration and finish of the handle 28.

Figure 7:
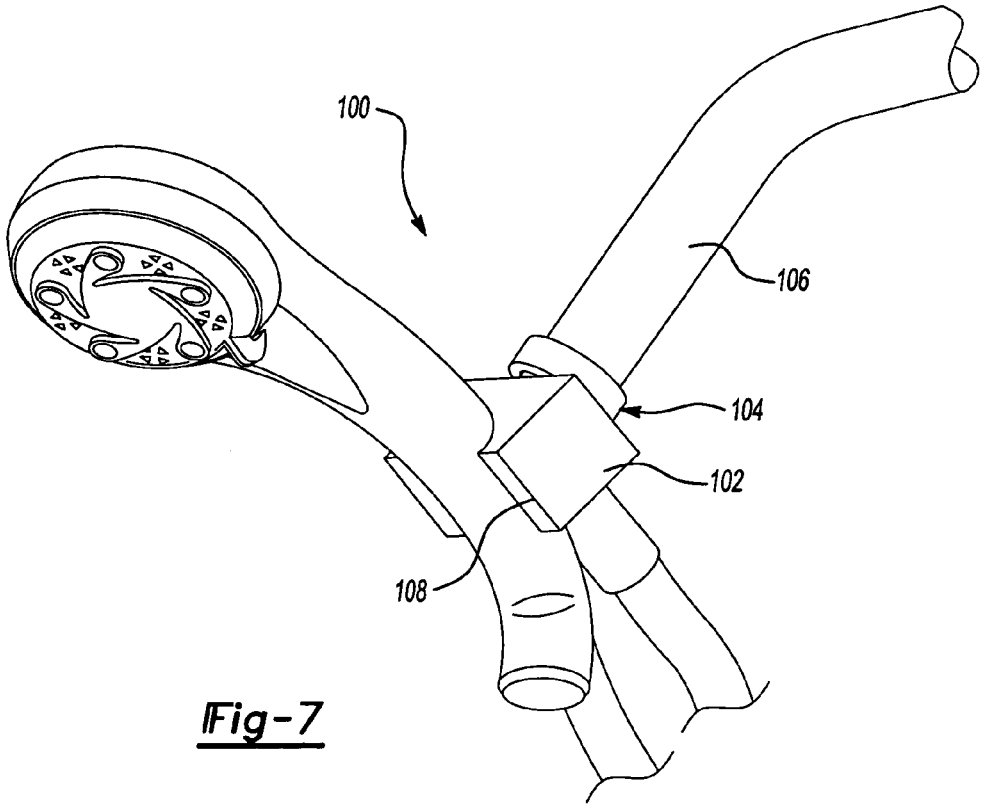
FIG. 7 is a perspective view of the example shower with a second example shower saddle.

FIG. 7 illustrates a perspective view of a second example shower mount 100 having a shower saddle 102. The shower mount 100 has a base member 104 that is adapted to fit a shower arm 106. The shower saddle 102 has a handle support 108 that corresponds to the configuration of a handle 110. The shower saddle 102 is supported on the base member 104 and is retained in a similar manner to that described above.

Figure 8:
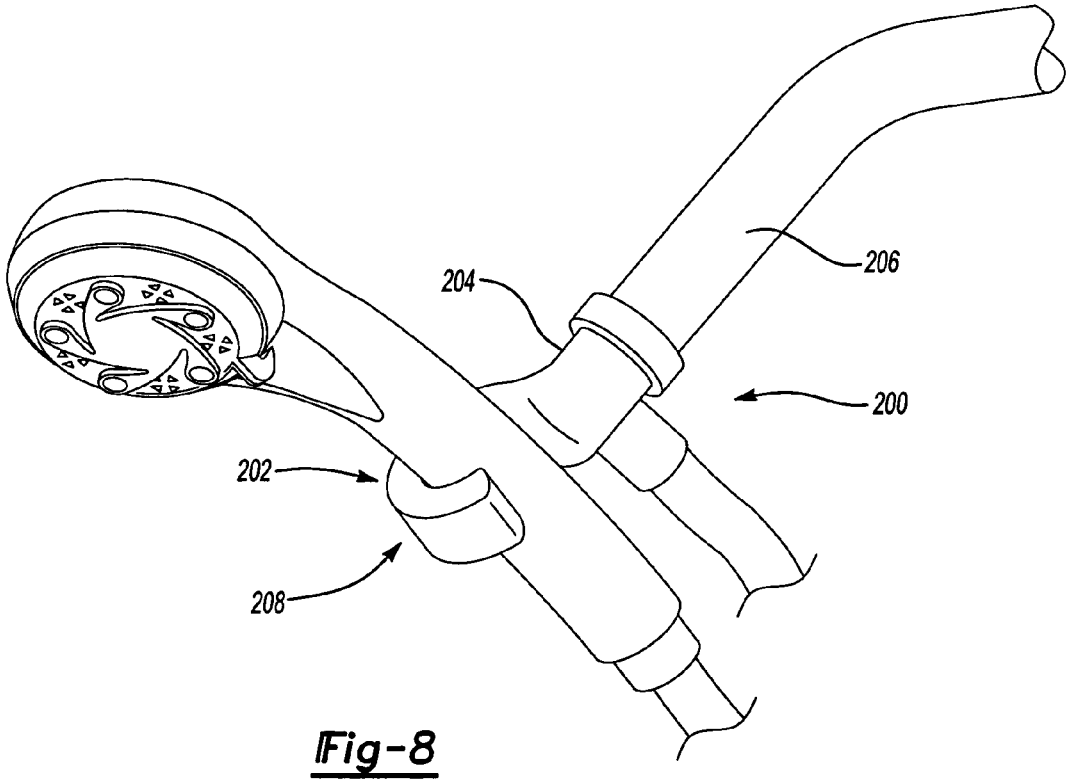
FIG. 8 is a perspective view of the example shower with a third example shower saddle.

FIG. 8 illustrates a perspective view of a third example shower mount 200 having a shower saddle 202. The shower mount 200 has a base member 204 that is adapted to fit a shower arm 206. The shower saddle 202 has a handle support 208 that corresponds to the configuration of a handle 210. The shower saddle 202 is supported on the base member 204 and is retained in a similar manner to that described above.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of mounting a hand-held shower comprising:

a) mounting a base member to a shower arm to connect to a water supply;

b) fluidly connecting a handle to the base member through a shower hose;

c) selecting one of a plurality of interchangeable shower saddles; and d) mounting the selected interchangeable shower saddle to the base member to support the handle and wherein step d) includes locking a first interlocking feature on the base member with a second interlocking feature on the shower saddle.

2. A shower comprising:

a shower arm extending from a wall and connected to a water supply;

a showerhead including a handle;

a base member fluidly connecting the handle to the shower arm through a shower hose and wherein the base member comprises a first interlocking feature; and an interchangeable shower saddle mounted to the base member to support the handle on the base member and wherein the shower saddle comprises a second interlocking feature to retain the shower saddle to the base member.

3. A method of mounting a hand-held shower comprising:

a) mounting a base member to a shower arm to connect to a water supply;

b) fluidly connecting a handle to the base member through a shower hose;

c) selecting one of a plurality of interchangeable shower saddles and;

d) mounting the selected interchangeable shower saddle to the base member to support the handle and wherein step d) includes locking a first interlocking feature on the base member with a second interlocking feature on the shower saddle.

4. A shower comprising:

a shower arm extending from a wall and connected to a water supply;

a showerhead including a handle;

a base member fluidly connecting the handle to the shower arm through a shower hose and wherein the base member comprises a first interlocking feature; and an interchangeable shower saddle mounted to the base member to support the handle on the base member and wherein the shower saddle comprises a second interlocking feature to retain the shower saddle to the base member and wherein the base member comprises a release to disconnect the first interlocking feature from the second interlocking feature.

5. A shower comprising:

a shower arm extending from a wall and connected to a water supply;

a showerhead including a handle;

a base member fluidly connecting the handle to the shower arm through a shower hose and wherein the base member comprises a first interlocking feature; and an interchangeable shower saddle mounted to the base member to support the handle on the base member and wherein the shower saddle comprises a second interlocking feature to retain the shower saddle to the base member and wherein the first interlocking feature is a protrusion extending from the base member and the second interlocking feature is a snap device which is biased toward a locked position.

6. The shower of claim 5, wherein the base member comprises a release to overcome the bias of the snap device to disconnect the snap device from the protrusion.

7. A hand-held shower comprising:

a showerhead including a handle;

a base member to fluidly connect the handle to a water supply; and an interchangeable shower saddle mounted to the base member to support the handle on the base member wherein the base member comprises a plurality of guiding features and the shower saddle comprises a plurality of guided features to align the shower saddle with the base member and wherein the base member comprises a release to disconnect the first interlocking feature from the second interlocking feature.

8. A hand-held shower comprising:

a showerhead including a handle;

a base member to fluidly connect the handle to a water supply; and an interchangeable shower saddle mounted to the base member to support the handle on the base member wherein the base member comprises a plurality of guiding features and the shower saddle comprises a plurality of guided features to align the shower saddle with the base member and wherein the first interlocking feature is a protrusion extending from the base member and the second interlocking feature is a snap device which is biased toward a locked position.

9. The hand-held shower of claim 8, wherein the base member comprises a release to overcome the bias of the snap device to disconnect the snap device from the protrusion.

* * * * *